US007255285B2

(12) United States Patent
Troost et al.

(10) Patent No.: US 7,255,285 B2
(45) Date of Patent: Aug. 14, 2007

(54) BLOCKED FLUE DETECTION METHODS AND SYSTEMS

(75) Inventors: Henry E. Troost, River Falls, WI (US); Richard Simons, Golden Valley, MN (US)

(73) Assignee: Honeywell International Inc., Morristown, NJ (US)

( * ) Notice: Subject to any disclaimer, the term of this patent is extended or adjusted under 35 U.S.C. 154(b) by 0 days.

(21) Appl. No.: 10/698,882

(22) Filed: Oct. 31, 2003

(65) Prior Publication Data

US 2005/0092851 A1 May 5, 2005

(51) Int. Cl.
*F23N 5/00* (2006.01)

(52) U.S. Cl. ..... 236/91 B; 431/22; 431/24; 431/75

(58) Field of Classification Search ..... 236/91 B; 431/22, 24, 75, 89
See application file for complete search history.

(56) References Cited

U.S. PATENT DOCUMENTS

| | | | | | |
|---|---|---|---|---|---|
| 3,909,816 | A | | 9/1975 | Teeters | |
| 4,221,557 | A | * | 9/1980 | Jalics | 431/22 |
| 4,483,672 | A | * | 11/1984 | Wallace et al. | 431/20 |
| 4,655,705 | A | * | 4/1987 | Shute et al. | 431/78 |
| 4,830,601 | A | | 5/1989 | Dahlander et al. | |
| 5,037,291 | A | | 8/1991 | Clark et al. | |
| 5,077,550 | A | | 12/1991 | Cormier | |
| 5,112,217 | A | | 5/1992 | Ripka et al. | |
| 5,126,721 | A | | 6/1992 | Butcher et al. | |
| 5,222,888 | A | | 6/1993 | Jones et al. | |
| 5,236,328 | A | | 8/1993 | Tate et al. | |
| 5,280,802 | A | | 1/1994 | Comuzie, Jr. | |
| 5,391,074 | A | * | 2/1995 | Meeker | 431/6 |
| 5,424,554 | A | * | 6/1995 | Marran et al. | 250/554 |
| 5,567,143 | A | | 10/1996 | Servidio | |
| 5,797,358 | A | | 8/1998 | Brandt et al. | |
| 5,971,745 | A | * | 10/1999 | Bassett et al. | 431/12 |
| 6,299,433 | B1 | | 10/2001 | Gauba et al. | |
| 2002/0099474 | A1 | | 7/2002 | Khesin | |

FOREIGN PATENT DOCUMENTS

| | | |
|---|---|---|
| EP | 0967440 | 12/1999 |
| EP | 1148298 | 10/2001 |
| WO | WO9718417 | 5/1997 |

* cited by examiner

*Primary Examiner*—Marc Norman

(57) ABSTRACT

The present invention is directed at systems and methods for detecting flue blockages in an HVAC system without the addition of numerous additional sensor elements, wiring, and connections that can unduly increase the cost and possibly reduce the reliability of the HVAC system. In an illustrative embodiment of the present invention, changes in the output of a flame sensor are used to detect when a likely flue blockage exists.

28 Claims, 6 Drawing Sheets

BLOCKED FLUE DETECTION METHODS AND SYSTEMS

FIELD

The present invention relates to HVAC heating systems, and more particularly, to monitoring and burner control methods and systems for such HVAC heating systems.

BACKGROUND

HVAC heating systems typically include a combustion chamber that works cooperatively with a burner. The burner receives fuel from a fuel source, and when ignited, provides the necessary heat to a controlled space. Gases from the combustion chamber typically exit the combustion chamber and the controlled space through a flue.

A problem recognized with some HVAC systems is that if the flue becomes sufficiently blocked or otherwise obstructed, gasses generated in the combustion chamber may fail to exit the chamber and thus the controlled space. Such gasses can back up into a house or building, creating hazardous conditions for occupants. A flue can become blocked for any number of reasons, including nesting animals, fallen sticks/leaves, ice blockages, and/or other objects or materials that may become lodged in the flue. In some cases, the flue may become sufficiently blocked by simply by build up of ash, creosote and/or other combustion waste vented from the chamber.

To help detect such flue blockages, pressure sensors, flow sensors, temperature sensors, and the like, are often provided in the flue to detect insufficient flow of exhaust gases through the flue. However, it has been found that these additional sensor elements, wiring, and connections can unduly increase the cost and possibly reduce the reliability of the HVAC system.

SUMMARY

The present invention is directed at systems and methods for detecting flue blockages without the addition of numerous additional sensor elements, wiring, and connections that can unduly increase the cost and possibly reduce the reliability of the HVAC system. In virtually all combustion systems, including HVAC heating systems, a flame sensor is already provided to detect if flame is present before the main fuel is turned on, and/or if the flame is lost after initial ignition and while the main fuel is turned on. If either of these conditions occurs, the HVAC system is typically shut down. In one illustrative embodiment of the present invention, the flame sensor is also used to detect a flue blockage.

During a heating cycle, a controller or the like may monitor the output signal from the flame sensor, and detect changes in the detected light output. By examining the detected light output, in some cases over time, the controller may determine if a flue has become blocked or even partially blocked.

In some embodiments, and because of normal flame signal variations, the output signal from the flame sensor may be time-averaged over a predetermined time period. The time averaged value may then be compared to a reference value to determine whether there is a flue blockage. In some embodiments, the reference level may be updated, from time to time, to reflect ongoing flame conditions.

DETAILED DESCRIPTION

The following detailed description should be read with reference to the drawings. The drawings, which are not necessarily to scale, depict illustrative embodiments and are not intended to limit the scope of the invention. While many of the embodiments described here relate to oil-burning HVAC systems, it should be recognized that the present invention is not so limited, and may be applied to any HVAC system that includes a flame and a flue. It should also be recognized that the phrase "flue blockage", as used herein, includes both partial and complete flue blockages, unless specifically noted otherwise.

Figure 1:
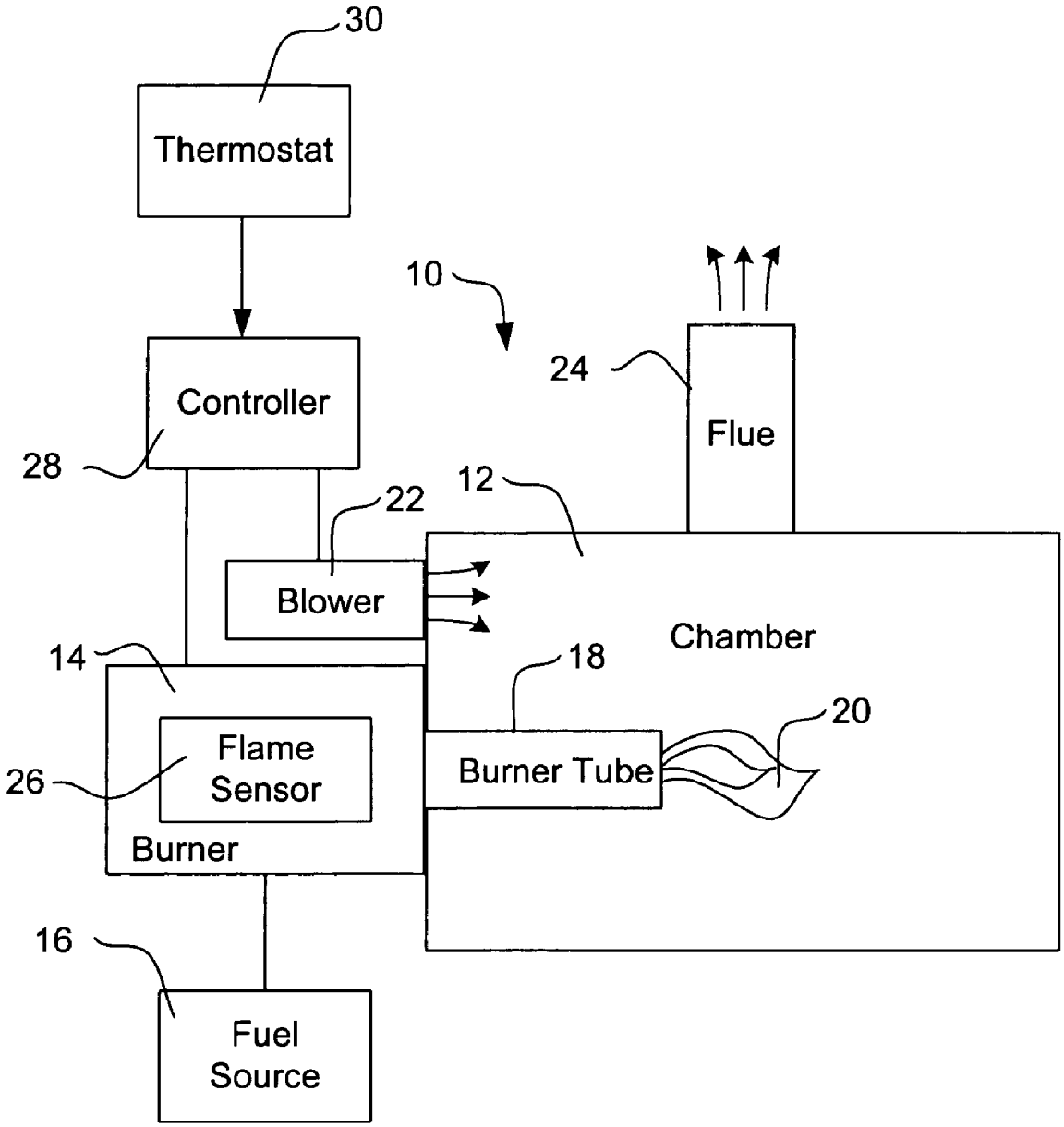
FIG. 1 is a highly diagrammatic schematic of an HVAC system.

FIG. 1 illustrates an oil-burning HVAC system, generally shown at 10, which includes a combustion chamber 12 that works cooperatively with a burner 14. The burner 14 receives fuel from a fuel source 16. The burner 14 includes a burner tube 18 that extends into the combustion chamber 12. A flame 20, when present, may extend out of the burner tube 18, as shown. A blower 22, which typically includes a blower fan shutter, provides forced air into the chamber 12 and is often controlled to optimize the flame 20. The blower 22 may also be used to purge vapors and gasses from the chamber 12 before and/or after a heating cycle. For example, during each heating cycle, the blower 22 may be used to purge the chamber 12 prior to flame ignition, as well as after the flame is turned off.

Gases from the combustion chamber 12 exit through a flue 24. In the illustrative embodiment, the burner 14 includes a flame sensor 26 that monitors the flame 20 through the burner tube 18. Often, the flame sensor 26 will be an optical sensor, such as a cadmium sulfide flame sensor, but it is recognized that any suitable flame sensor may be used.

In typical operation, a controller 28 receives a call for heat from a thermostat 30. The controller 28 then sends a call for activation of the burner 14 and blower 22. The blower 22 may remove any residual gasses or vapors from the chamber 12 prior to flame ignition. Then, an ignition sequence may start, with the burner 14 operated to start a flame 20 in the burner tube 18. The flame sensor 26 may be used to monitor the ignition sequence, and determine whether the fuel provided by the burner 14 properly ignites. If the fuel does not properly ignite, the controller may retry the ignition sequence, and eventually move into a lockout state, where the flow of fuel is stopped. Once in the lockout state, a technician may be needed to reset the system, since failure to ignite often indicates a problem with the system and/or unsafe operating conditions.

As indicated above, the flue 24 may become blocked for any number of reasons, including nesting animals, fallen sticks/leaves, ice blockage, and/or a variety of objects or materials that can become lodged in the flue 24. The flue 24 can also be blocked by buildup resulting from ash, creosote and other combustion waste vented from the chamber 12. If sufficiently obstructed, the flue 24 may fail to allow sufficient gasses from the burning of fuel to exit the chamber 12. Such gasses can back up into a house or building, creating hazardous conditions for occupants. Carbon monoxide or other gas detectors can be used to determine whether the atmosphere near the system 10 is becoming hazardous. These sensors only detect such problems after the interior air has become contaminated. Also, such sensors complicate wiring and layout, as well as increasing costs, of a system 10.

Many HVAC systems operating in a series of sequential heating cycles to maintain a desired temperature in an inside space relative to a temperature set point. Each heating cycle is typically initiated by a call for heat, typically provided by a thermostat or other control device. Each heating cycle typically ends when the HVAC system has satisfied the current heating needs of the inside space, which is typically also indicated by a thermostat or the like.

Figure 2:
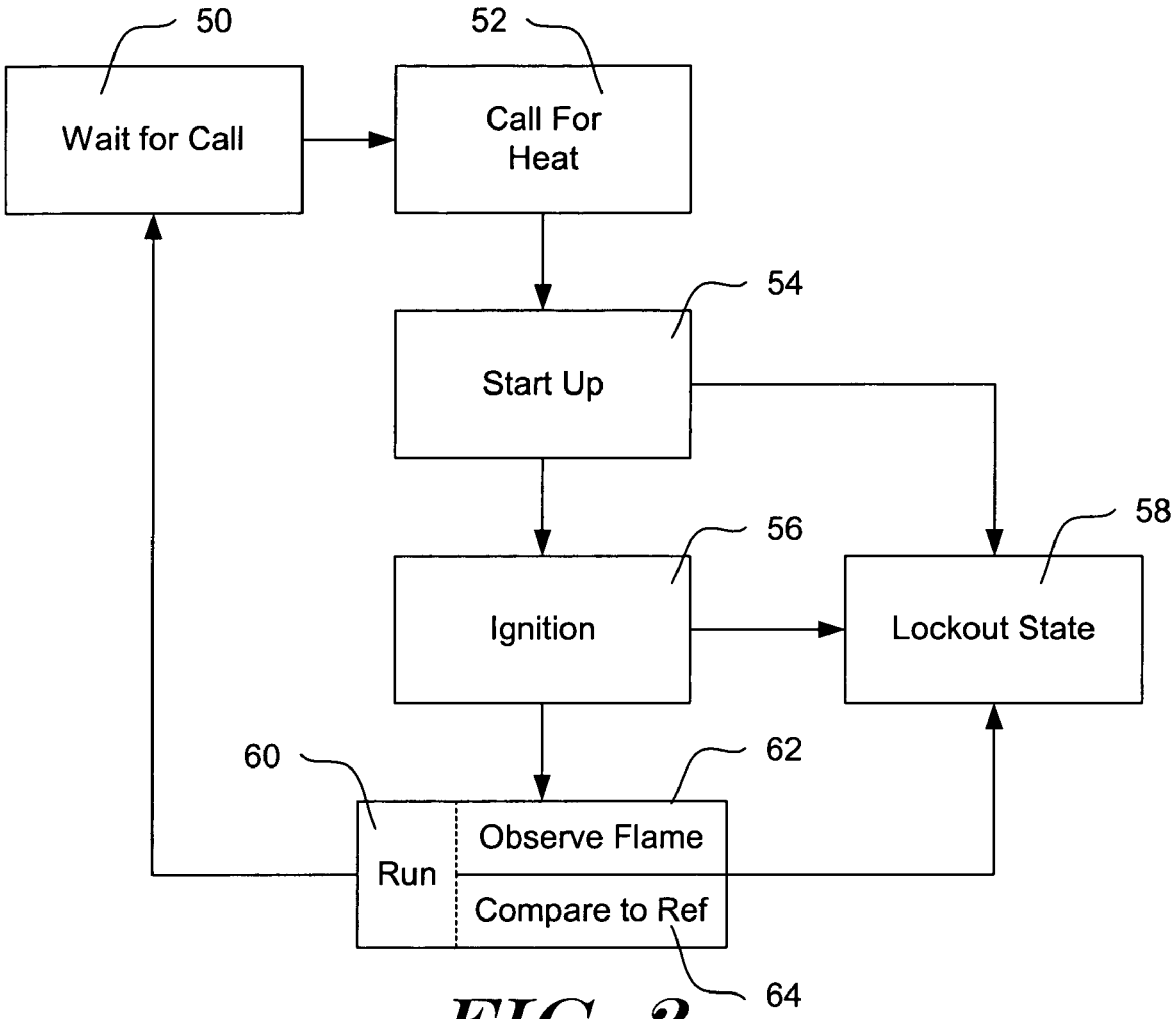
FIG. 2 is a flow chart for an illustrative method for detecting flue blockage.

FIG. 2 is a flow chart showing an illustrative method for detecting a flue blockage in accordance with the present invention. The illustrative method begins in a wait for call state 50, indicating that the system is not operating the burner and is waiting for a call for heat. When a call for heat 52 occurs, the system may enter startup state 54, which may include a number of steps for determining whether it is safe to ignite the burner 18. If an unsafe condition is detected, the system may enter a lockout state 58, where the burner will not be operated or ignited, sometimes until a service technician performs maintenance.

If startup 54 is passed safely, the system enters ignition state 56. During ignition state 56, the system begins feeding fuel to a burner while also providing for ignition. During ignition, fuel is typically fed past a pilot light, which then ignites the burner, or fuel is provided to the burner and a sparking device provides a spark that directly ignites the burner. Also during ignition state 56, a flame sensor, such as flame sensor 26 of FIG. 1, may be used to observe the flame produced by the burner and determine whether a flame has been ignited. If the flame fails to ignite within a predetermined time period, the system may enter the lockout state 58. If the flame does ignite and is sensed, then the system may enter a run state 60.

The flame sensor may be any type of sensor capable of detecting a flame. For example, the flame sensor may be an optical device that has an electrical characteristic that changes when light is incident on a window or other area of the flame sensor. Although not limiting, one such flame sensor includes a resistive element that varies in resistance in response to visible or other wavelengths of light. The flame sensor may provide a voltage, current, frequency, or any other suitable output signal, as desired. Semi-conducting devices and/or photodiodes may also be used, as well as non-optical devices such as heat sensitive devices, if desired.

In the illustrative example of FIG. 2, the run state 60 shows two steps, though other steps may also be part of the run state 60. In FIG. 2, the run state 60 includes the step of observing the flame 62 to capture a flame value or series of flame values, and the step of comparing the flame value or values to a reference value 64. In some cases, the flame value is derived from the output or a series of outputs from the flame sensor, and is preferably a quantitative (rather than qualitative) output of the flame sensor. For example, some flame sensors may be adapted to only provide a qualitative output of "FLAME ON" or "FLAME OFF". For the present invention, however, the flame sensor preferably provides a quantitative output (outputs that may take on a number of values across a range). For example, one quantitative output would be a resistance value that, in response to light, varies from 300 ohms to 500 ohms of resistance. Other examples include an avalanche photodetector that outputs a current in response to incident light, or a phototransistor that receives light at the base of a bipolar junction transistor. The quantitative output may take on a number of forms including resistance, voltage, current, frequency, or any other suitable form.

In the run state 60, the flame is observed at 62 and compared to a reference at 64. In some embodiments, an acceptable range is defined around the reference value. If, in a numerical example, the flame output, or a flame value derived therefrom, is a measured resistance that varies between 150 and 500 ohms, the reference value may be chosen as the resistance measured when the burner is on and known to be correctly operating with proper ventilation and exhaust through the flue. Continuing with the numerical example, if the measured resistance is 300 ohms under these conditions, then it may be determined that a tolerance of 75 ohms is allowed, such that the acceptable reference range is 300+/−75 ohms, i.e. from 225 to 375 ohms. Thus, as long as the flame output, or a flame value derived therefrom, is measured and found to be within this range, the numerical example will continue to operate in the run state 60 until either the call for heat is satisfied or the flame output (or flame value) is no longer in the acceptable range (barring, of course, some other intervening event such as a power outage). If the flame output, or a flame value derived therefrom, falls outside the acceptable reference range, and in some cases falls outside the acceptable reference range for a predetermined duration of time, the system may enter the lockout state 58. If the call for heat is satisfied without the flame output (or flame value) falling outside the acceptable range, then the system may return to the wait for call state 50.

Upon startup of the combustion process, the flame sensor output may change a relatively large amount for a period of time, such as 3 minutes. After this period of time, however, the combustion process may become relatively stable. To help reduce the possibility of assigning a reference value using an output value of the flame sensor during the startup of the combustion process, the method may include a delay step that delays the assigning of a reference value for a period of time after the ignition state 56 is entered. Alternatively, or in addition, a value produced by the flame sensor may be periodically recorded during the startup of the combustion process, and each value may be compared to the previous value or several previous values. In one illustrative embodiment, if the last "n" (where "n" is an integer greater than zero) values are monotonically increasing (or decreasing), each by more than a predetermined amount, then a reference value is not assigned. Once the combustion process becomes relatively stable, the last "n" values will no longer be monotonically increasing (or decreasing), each by more than a predetermined amount, and thus a reference value may be assigned.

To help compensate for normal flame variation, it may be desirable to take a number of readings from the flame sensor over a period of time, and average those readings to arrive at a more representative value of true flame conditions. For example, to arrive at a flame value, three flame sensor readings may be taken over a ten second period of time, and mathematically averaged to provide the flame value. Likewise, to arrive at a reference value, three flame values, taken over different periods of time, may be mathematically averaged to provide the reference value. The number of readings and time period of these readings may be varied, depending upon the particular characteristics of the system.

In some illustrative embodiments, and during the run state 60, the reference value may be periodically reset. Resetting the reference value may or may not be provided, depending on the appliance characteristics, as well as other factors. For example, it may be desirable to reset the reference value when windows and/or doors have been opened or closed within the structure, and/or when any other change in system or environmental conditions occurs.

In one embodiment, the reference value is reset to a new measured value, or a new "averaged" value as described above, at a predetermined time interval, such as every five minutes. The resetting of the reference value may or may not include various checks. For example, hard upper and/or lower limit checks may be set for the reference value, and the system may prevent the resetting of the reference value outside of these limits.

Other checks may also be performed. For example, and continuing with the above numerical example, individual measured resistance values may be taken at a predetermined number (e.g. three) of consecutive time periods (e.g. one minute). One illustrative check may determine if any of the individual measured resistance values varies from another by more than five ohms. If not, the reference value may be reset to a new reference value. The new reference value may be an average of the individual reference values. Table 1 below illustrates one example:

TABLE 1

| Time | Measured | Ref | Tolerance | Δ |
|---|---|---|---|---|
| Minute 1 | 318 | 300 | 75 | 18 |
| Minute 2 | 285 | 300 | 75 | 15 |
| Minute 3 | 311 | 300 | 75 | 11 |
| Minute 4 | 314 | 300 | 75 | 14 |
| Minute 5 | 310 | 300 | 75 | 10 |
| Minute 6 | 315 | 313 | 75 | 3.3 |
| Minute 7 | 325 | 313 | 75 | 12 |
| Minute 8 | 299 | 313 | 75 | 14 |

Referring to Table 1 above, after the first three minutes of a heating cycle, the individual measured resistance values vary from one another by more than five ohms, and thus, the reference value "Ref" is not reset. Likewise, at minute four, the individual measured resistance values taken at minutes two through four vary from one another by more than five ohms, and thus, the reference value is not reset. At minute five, the individual measured resistance values taken at minutes three through five also vary from one another by more than five ohms, and thus, the reference value is not reset. At minute 6, however, the individual measured resistance values taken at minutes four through six do not vary from one another by more than five ohms, and thus, the reference value is reset to the average of the individual measured resistance values taken during minutes four through six. At minutes 7 and 8, the individual measured resistance values taken from the current and two previous minutes vary from one another by more than five ohms, and thus, the reference value is not reset.

Other checks may also be performed, as desired. For example, there may be a limit to the amount of adjustment that may occur during any single reset, such as five ohms. Checks may also be performed to identify trends or changes that may indicate that a flue is becoming gradually blocked, as by an animal building a nest over time.

Because many HVAC systems already include a flame sensor and are controlled by a microcontroller, the present invention may be incorporated into existing HVAC systems by simply providing new software to the microcontroller. This may make the present invention a less expensive way to provide blocked flue detection to existing and new systems. It should be recognized, however, that the present invention is not so limited, and may be implemented in any suitable manner, including using analog timers, comparators and/or discrete logic gates, as desired.

Figure 3:
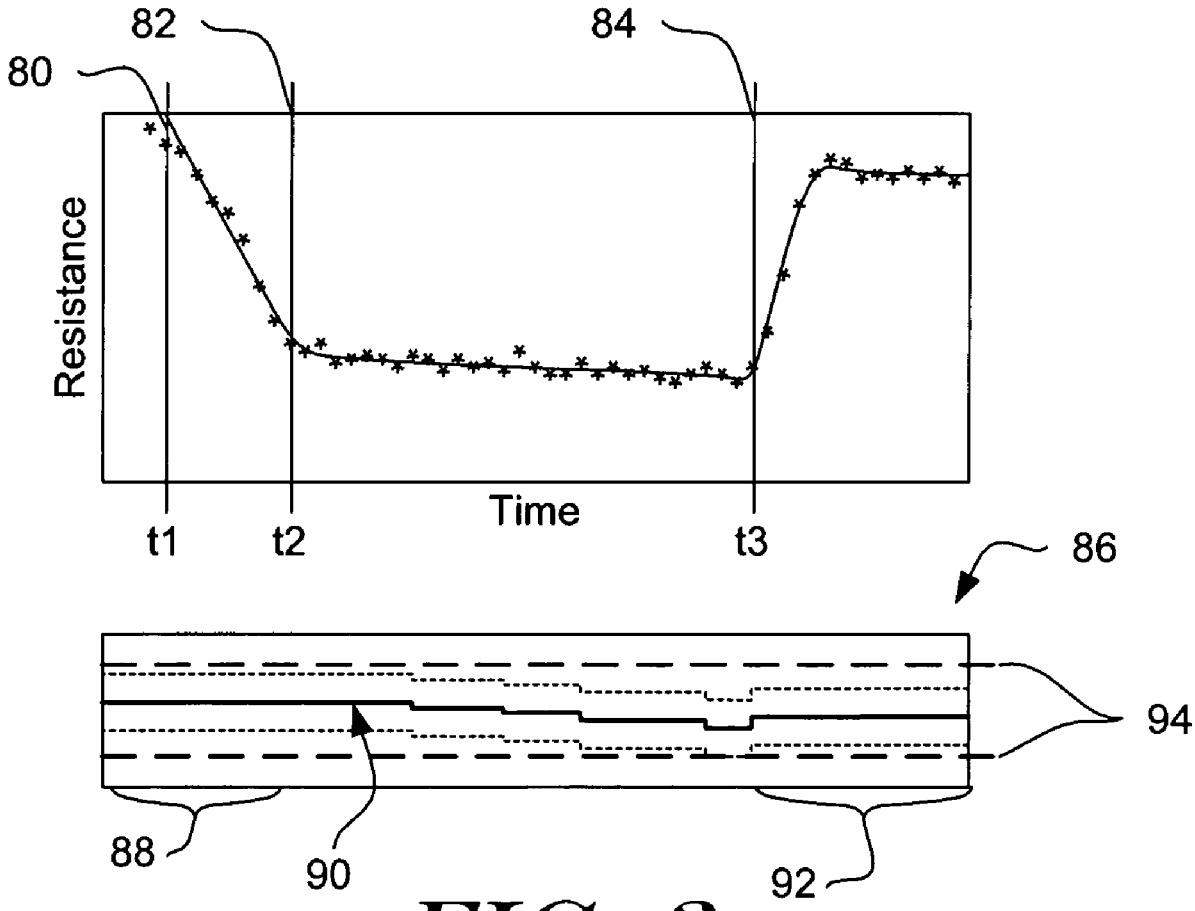
FIG. 3 illustrates a graph of an idealized reference value and sensor output for an illustrative flue blockage detection method.

FIG. 3 illustrates a graph of an idealized reference value and sensor output for an illustrative flue blockage detection method. The illustrative graph shows the resistance of a flame sensor versus time. A line is shown fitted to idealized measured resistance values, which are shown by the asterisks. At a first time t1, shown at 80, a call for heat occurs, and so an ignition sequence begins. In the illustrative embodiment, and as ignition occurs and the flame begins to glow and burn brightly, the resistive output of the flame sensor drops until, at time t2 at 82, it begins to level off. The illustrative example uses a flame sensor that has an effective resistance that goes down when exposed to light; this may occur, for example, with some semiconductors as well as a variety of other devices. Other devices that undergo different changes may be used. At a third time t3, as shown at 84, the flue is blocked, causing a significant change in the flame sensor output.

Typically there will be some variation in the output value during operation. In the short term, there will be some random noise that causes variation in the measured resistance values. Over a longer time period, as shown from time t2 to time t3, and as shown at 84, there may be some device drift or changes caused by changing conditions in the environment such as doors and/or windows opening or closing.

Shown on the separate lower scale 86 is a reference value. During an ignition stage 88, the reference value is not relevant and in some embodiments, may not even be calculated. As steady state operation is achieved, as shown between times t2 and t3, the reference value shown at 90 may occasionally be reset, to compensate for drift over time as well as any changing system and/or environmental conditions. In the example shown, the reference value 90 is updated at five minute intervals, though shorter and longer intervals may be used. In some embodiments, and as part of the adjustment of the reference value 90, hard upper and lower limits 94 may be defined, preventing the reference value 90 from reaching a value that is out of an acceptable reference range.

Figure 4:
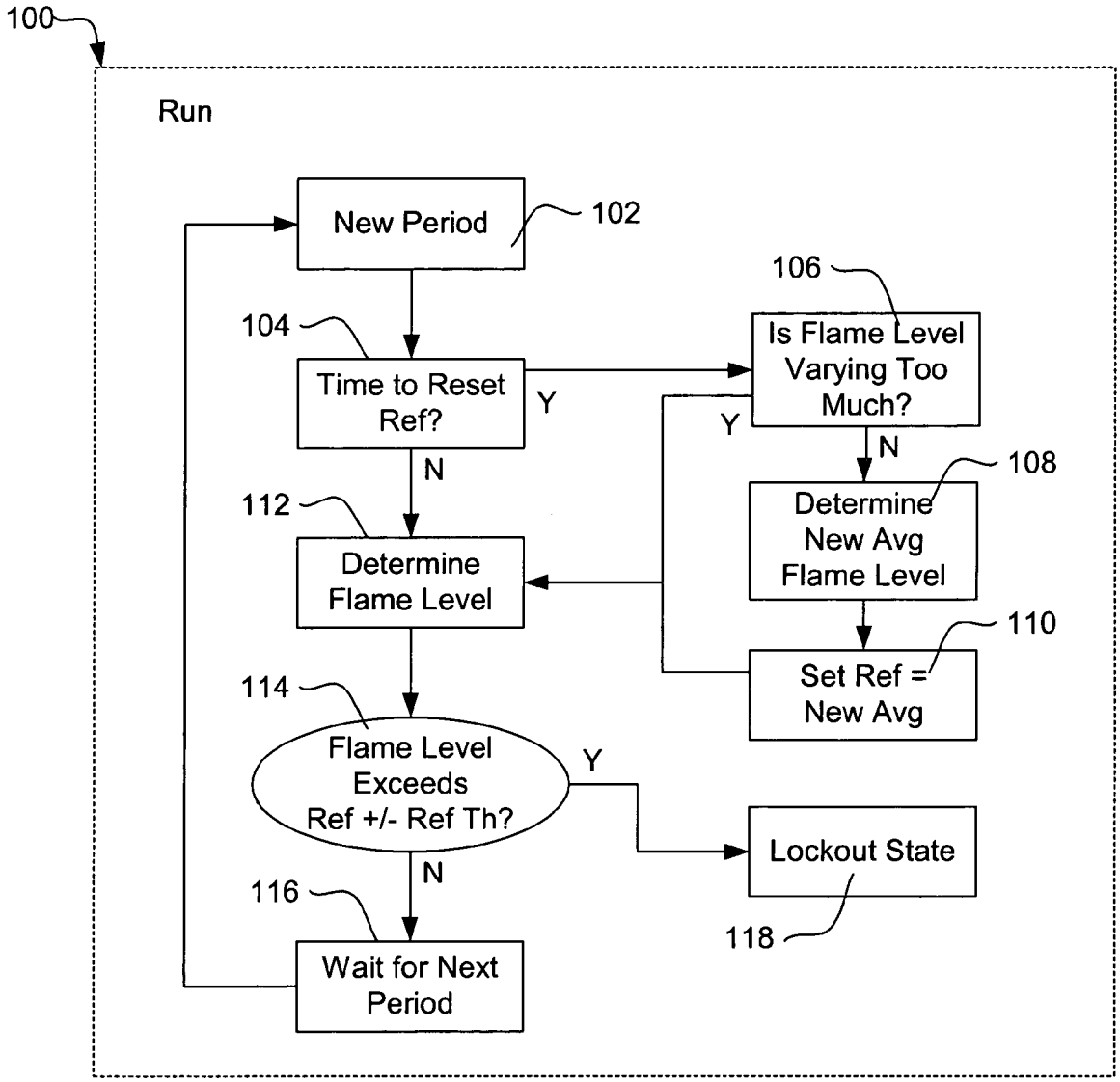
FIG. 4 is another flow chart showing steps within an illustrative method for detecting flue blockage.

FIG. 4 is another flow chart showing steps of an illustrative method for detecting a flue blockage. In the illustrative embodiment, the flow chart shows steps that may occur within a run state 100. At the start of a new time period, shown at block 102, the illustrative method determines whether it is time to reset the reference value, as shown at block 104. As noted above, this may occur at, for example, five minute intervals. Alternatively, or in addition, the reference value may be reset when the measured resistance values from the flow sensor have moved away from the current reference value, often due to changing system or environmental conditions.

If it is time to reset the reference value, and in the illustrative embodiment, it is first determined if the flame level is currently varying too much, as shown at block 106. If the flame level is currently varying by more than a predetermined amount, the reference value may not be reset because the measurements may be unstable, and control is passed to block 112 where a new flame level is observed. If the flame level is not varying by more than a predetermined amount, control may be passed to block 108 Block 108 may average the flame level for a number of past several time periods, as shown at 108, and the reference value is reset to the new "average" value, as shown at 110. Control is then passed to block 112, where a new flame level is observed.

Once a new flame level is observed at block 112, the measured flame level (or an average of a number of flame levels) may be compared to the reference value. In the illustrative embodiment, block 114 determines if the measured flame level (or an average of a number of flame levels) falls outside of a range defined by the reference value plus or minus a reference threshold. The reference threshold defines an acceptable range around the reference value. If the flame level (or an average of a number of flame levels) does not fall outside of the range defined by the reference value plus or minus the reference threshold (i.e. the flame level is within the acceptable range around the reference value), then control is passed to block 116, which waits for the next time period to begin. If, however, the measured flame level (or an average of a number of flame levels) falls outside of the range defined by the reference value plus or minus the reference threshold, control is passed to a lockout block 118.

Figure 5:
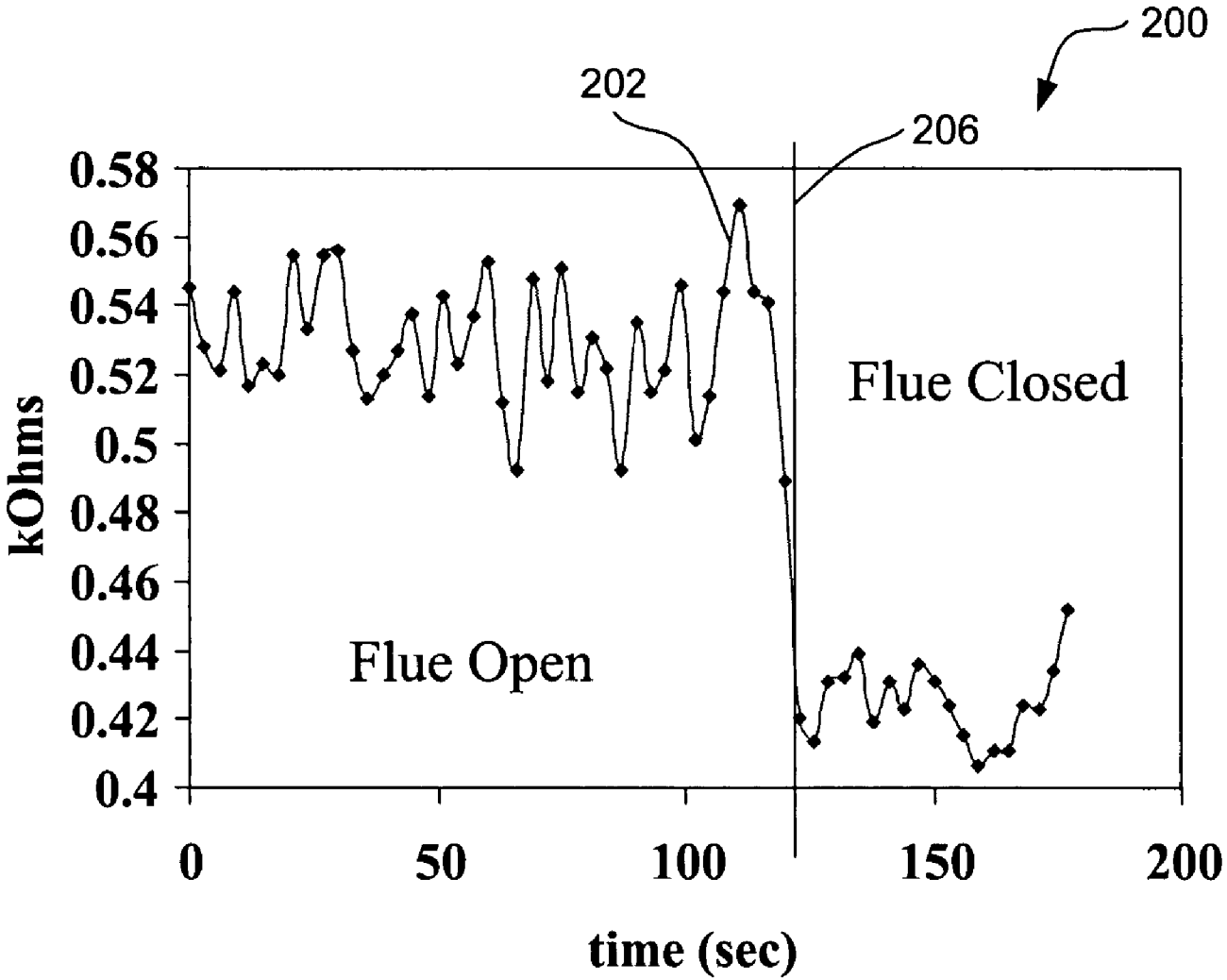
FIG. 5 is a graph of actual sensor output under varying flue conditions.

FIG. 5 is a graph 200 showing an actual sensor output versus time under varying flue conditions. To gather data for the graph 200, an oil burner having a resistive output flame sensor was coupled to a flue equipped with a device that allowed the flue to be selectively opened and closed. The burner also included a damper that could be selectively opened and closed. The damper was used to control the oxygen content in the combustion chamber, and thus the flame characteristics. For these tests, the flame sensor was of a type that decreased in resistance when exposed to light, although as indicated above, any type of flame sensor may be used.

In FIG. 5, the graph 200 shows a trace 202 that corresponds to the resistance value of the flame sensor versus time. Initially, with the flue open (before time 206), the resistance of the flame sensor varies at between 490 and 570 ohms. At time 206, the flue is closed. As can be seen, the resistance curve 202 of the flame sensor drops significantly, and begins varying in the range of about 210 to 440 ohms. The present invention may be used to monitor the resistance of the flame sensor, and detect the change in resistance in the flame sensor output that occurs at time 206 and determine that a blocked flue has occurred.

Figure 6:
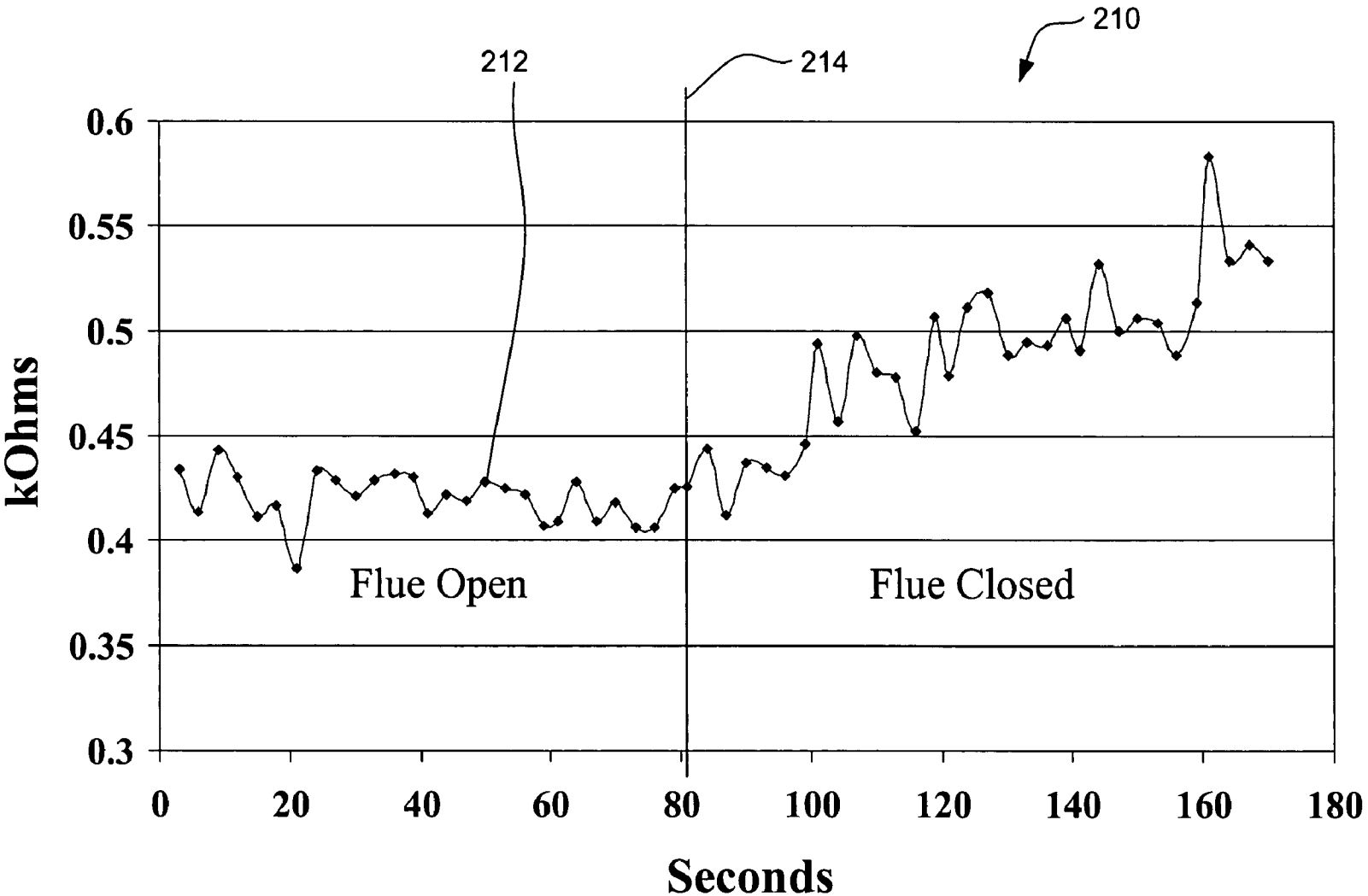
FIG. 6 is another graph of actual sensor output under varying flue conditions.

FIG. 6 is another graph 210 showing an actual sensor output under varying flue conditions. The graph 210 was gathered in a similar fashion to that of FIG. 5. However, the burner was operated under different and more inefficient conditions for FIG. 6. Before a first time 214, the graph illustrates a resistance curve 212 with the flue open. When the flue is closed at first time 214, the resistance curve 212 begins to climb steadily. Like above, the present invention may be used to monitor the resistance of the flame sensor, and detect the change in resistance in the flame sensor that occurs beginning at time 214 and determine that a blocked flue has occurred.

FIGS. 5 and 6 illustrate that the flame sensor output may vary in different ways when the flue becomes blocked or is otherwise closed, depending on system and environmental conditions. Under some conditions, more light will reach the flame sensor when the flue is blocked, while under other conditions, less light will reach the flame sensor. It is believed that under some conditions, a flue blockage may produce a sooty flame, which may burn more brightly than an efficient flame. Under other conditions, it is believed that a flue blockage may cause the air between the flame and the flame sensor to become dirty and sooty, which can block out a portion of the light emitted by the flame. According to the present invention, both of these conditions can be detected, because it is the change (positive or negative) in the output of the flame sensor that can be detected to determine that a flue blockage has occurred.

Those skilled in the art recognize that the present invention may be manifested in a variety of forms other than the specific embodiments described and contemplated herein. Accordingly, departures in form and detail may be made without departing from the scope and spirit of the present invention as described in the appended claims.

What is claimed is:

1. A method of determining whether a flue is at least partially blocked in an HVAC system that includes a burner and a flue, wherein the flue serves as an exhaust port for the burner, the method comprising:

monitoring the intensity of a flame of the burner;

determining if the intensity of the flame of the burner likely corresponds to an at least partial blockage of the flue;

operating the HVAC system in a number of heating cycles to maintain a desired temperature in an inside space relative to a temperature set point; and performing both the monitoring and determining steps during at least one of the heating cycles.

2. A method according to claim 1 wherein the monitoring step includes the step of determining a flame value related to the intensity of the flame.

3. A method according to claim 2 wherein the determining step includes the step of comparing the flame value to a reference value.

4. The method of claim 3 wherein the reference value can be reset to a new reference value.

5. The method of claim 4 further comprising:

observing the flame value at a first time and a second time;

if the flame value varies by less than a predetermined amount from the first time to the second time, resetting the reference value to the new reference value.

6. The method of claim 5 wherein the new reference value is an average of previous flame values.

7. The method of claim 3 further comprising:

determining a difference between the flame value and the reference value;

if the difference exceeds a predetermined threshold, determining that the flue is blocked.

8. The method according to claim 3 further comprising:

determining a difference between the flame value and the reference value;

if the difference exceeds a predetermined threshold for a predetermined duration of time, determining that the flue is blocked.

9. The method of claim 2 wherein the flame value is related to a flame sensor output taken at different times.

10. The method of claim 9 wherein the flame value is an average of the flame sensor output taken at different times.

11. The method of claim 2 wherein the step of determining a flame value includes the steps of:

sampling the output of the flame sensor at a first time for a first output value and a second time for a second output value; and averaging the first output value and the second output value.

12. The method of claim 1 wherein the HVAC system includes a flame sensor that produces an output, the flame sensor being disposed to monitor the intensity of the flame of the burner, and wherein the step of monitoring the flame includes monitoring the flame sensor output.

13. The method according to claim 1 wherein the burner is disposed in a chamber, and the step of monitoring the intensity of the flame of the burner includes optically observing the intensity of light in at least part of the chamber.

14. A method according to claim 1 wherein the monitoring and determining steps are performed more than one time during at least one of the heating cycles.

15. A method according to claim 14 wherein the monitoring and determining steps are performed multiple times during each of two or more of the heating cycles.

16. A controller for used with an HVAC system, the HVAC system having a burner and a flue wherein the flue serves as an exhaust for the burner, the HVAC system further having a flame sensor for monitoring the flame of the burner, the controller comprising:

monitoring means adapted to receive and monitor an output signal from the flame sensor, wherein the output signal can indicate, among other things, the presence or absence of a flame; and determining means for determining if the output signal of the flame sensor indicates that the flue is at least partially blocked, wherein the determining means compares a value related to the output signal of the flame sensor to a reference value.

17. An HVAC system comprising:

an oil burner disposed within a chamber having a flue;

a flame sensor disposed to optically monitor a flame produced by the oil burner; and a controller adapted to receive and monitor an output signal of the flame sensor, and for determining if the output signal of the flame sensor indicates that the flue is at least partially blocked by comparing a value related to the output signal of the flame sensor to a reference value.

18. A controller-readable medium having program stored thereon, such that when executed by a controller of an HVAC system having a burner that produces a flame, a flue for providing an exhaust for the burner, and a flame sensor for monitoring the flame of the burner, the controller is capable of performing the following steps:

receiving a flame value related to the flame sensor output;

during an ignition sequence, using the flame value to determine if a flame is present, and if a flame is present, allowing the HVAC system to continue;

comparing the flame value to an acceptable flame value range; and if the flame value is outside of the acceptable flame value range, indicating that the flue may be at least partially blocked.

19. The controller-readable medium of claim 18 wherein the acceptable value range comprises a range about a reference value, the program, when executed by a controller, also being capable of performing the steps of:

determining whether, during a specified time period, the flame value has been stable within predetermined limits; and if the flame value has been stable within the predetermined limits, adjusting the reference value to be closer to the flame value.

20. An HVAC system comprising:

an oil burner disposed within a chamber having a flue;

a flame sensor having a flame sensor output, the flame sensor adapted to optically monitor a flame produced by the oil burner; and a controller adapted to determining whether, during a specified time period, a flame value that is related to the flame sensor output has been stable within predetermined limits; and if the flame value has been stable within the predetermined limits, adjusting the reference value to be closer to the flame value.

21. An HVAC system according to claim 20 wherein the flame value is an average of two or more flame sensor output values.

22. An HVAC system according to claim 21 wherein the reference value is an average of two or more flame sensor output values.

23. A method of determining whether a flue is at least partially blocked in an HVAC system that includes a burner and a flue, wherein the flue serves as an exhaust port for the burner, the method comprising:

monitoring the intensity of a flame of the burner using a flame sensor that produces a flame sensor output, and determining a flame value that is related to an average of the flame sensor output taken at different times; and determining if the intensity of the flame of the burner likely corresponds to an at least partial blockage of the flue.

24. A method of determining whether a flue is at least partially blocked in an HVAC system that includes a burner and a flue, wherein the flue serves as an exhaust port for the burner, the method comprising:

monitoring the intensity of a flame of the burner using a flame sensor that produces a flame sensor output, and determining a flame value that is related to the intensity of the flame;

determining if the intensity of the flame of the burner likely corresponds to an at least partial blockage of the flue by comparing the flame value to a reference value;

observing the flame value at a first time and a second time; and if the flame value varies by less than a predetermined amount from the first time to the second time, resetting the reference value to the new reference value.

25. A method of determining whether a flue is at least partially blocked in an HVAC system that includes a burner and a flue, wherein the flue serves as an exhaust port for the burner, the method comprising:

monitoring the intensity of a flame of the burner and determining a flame value that is related to the intensity of the flame;

comparing the flame value to a reference value;

determining a difference between the flame value and the reference value;

if the difference exceeds a predetermined threshold for a predetermined duration of time, determining that the flue is blocked.

26. A method of determining whether a flue is at least partially blocked in an HVAC system that includes a burner and a flue, wherein the burner is disposed in a chamber, and wherein the flue serves as an exhaust port for the burner, the method comprising:

monitoring the intensity of a flame of the burner by optically observing the intensity of light in at least part of the chamber; and determining if the intensity of the flame of the burner likely corresponds to an at least partial blockage of the flue.

27. A controller-readable medium having program stored thereon, such that when executed by a controller of an HVAC system having a burner that produces a flame, a flue for providing an exhaust for the burner, and a flame sensor for monitoring the flame of the burner, the controller is capable of performing the following steps:

receiving a flame value related to the flame sensor output;

comparing the flame value to an acceptable flame value range;

if the flame value is outside of the acceptable flame value range, indicating that the flue may be at least partially blocked;

determining whether, during a specified time period, the flame value has been stable within predetermined limits; and if the flame value has been stable within the predetermined limits, adjusting the reference value to be closer to the flame value.

28. An HVAC system comprising:

a burner for selectively providing a burner flame;

a flue serving as an exhaust port for the burner;

a sensor for monitoring the burner flame, the sensor providing a sensor output that indicates an intensity of the burner flame;

a controller coupled to the sensor, the controller monitoring the sensor output and determining if a burner flame is present after ignition of the burner, and if a flame is present, allowing the HVAC system to continue;

the controller also monitoring the sensor output and determining if the intensity of the burner flame is outside of an acceptable limit, indicating that the flue may be at least partially blocked.

* * * * *